US005803520A

United States Patent [19]

Bagrowski, III

[11] Patent Number: 5,803,520

[45] Date of Patent: Sep. 8, 1998

[54] FIXTURE FOR HOISTING AND REMOVAL OF TRUCK BEDS

[76] Inventor: Henry Bagrowski, III, 668 Main St., Wilmington, Mass. 01887

[21] Appl. No.: 610,991

[22] Filed: Mar. 5, 1996

[51] Int. Cl.[6] ..... B66C 1/66

[52] U.S. Cl. ..... 294/67.33; 294/67.5; 294/81.21; 294/81.3; 294/93

[58] Field of Search ..... 294/67.1, 67.3, 294/67.33, 67.5, 81.1–81.4, 81.5, 81.54, 81.62, 90, 93, 94, 119.1

[56] References Cited

U.S. PATENT DOCUMENTS

| | | | |
|---|---|---|---|
| 2,284,238 | 5/1942 | Todd | 294/81.54 |
| 2,572,873 | 10/1951 | Luke | 294/93 |
| 2,987,340 | 6/1961 | Mattera | 294/81.21 X |
| 4,553,719 | 11/1985 | Ott | 294/67.33 X |
| 4,973,094 | 11/1990 | Tana et al. | 294/81.21 |
| 5,306,062 | 4/1994 | Dodge | 294/93 X |

*Primary Examiner*—Johnny D. Cherry
*Attorney, Agent, or Firm*—Mark P. White

[57] ABSTRACT

A fixture to be used in conjunction with a standard engine crane for the hoisting of fleet-bed truck bed is disclosed and claimed. The fixture comprises a pair of struts joined at their center by a cross member, thus forming an I-shaped structure. At the end of each strut is an adjustable extension arm assembly, configured so that the I-shaped structure may be lowered into the truck bed, adjusted for a snug fit, and the adjustments fixed and secured. One or more brackets are located on the I-structure, so that a chain or other device may be fastened between the I-structure and engine crane, allowing a single operator to perform all the manipulations required to easily and safely lift the truck bed off the truck chassis.

9 Claims, 5 Drawing Sheets

FIXTURE FOR HOISTING AND REMOVAL OF TRUCK BEDS

BACKGROUND OF THE INVENTION

FIELD OF THE INVENTION

1. Description Relative to the Prior Art

It is frequently required to remove the body or bed of small trucks during the repair of such vehicles.

A number of hoists and lifts are commonly used in vehicle service stations and repair shops. Although many of the larger facilities have customized lift and hoist facilities cable of lifting small truck bodies off the truck frame, there appears to be no solution to this problem available to the majority of the repair facilities for the removal of said truck bodies.

Such truck beds typically weigh between 375 and 400 pounds. To lift and remove such a bed generally requires a minimum of between three and six people. The people so engaged are exposed to various potential injuries, including, but not limited to strains of the back and neck, and crushing injuries from dropping or lowering the weight on parts of the bodies of the persons performing the lifting and removal.

Most small repair facilities do have access to a standard engine crane, however. The engine crane is used to assist in the removal of engines from cars and trucks, a job which is quite common in such repair facilities. The engine crane is designed to lift an engine up and out of the engine compartment, and thus has a geometry appropriate for use in the removal of truck beds as well.

However, the standard truck bed does not provide any appropriate lift points or fixtures which would allow the use of the engine crane for this purpose.

The current invention provides a means by which the standard engine crane can be adapted to the hoisting and removal of the standard truck bed of the "fleet-side" type. This "fleet-side" bed has a lip which is available to use with the current invention. By means of this invention, a single workman can, with the assistance of the engine crane, remove the truck bed with comparative ease, and without needlessly exposing himself to the dangers inherent in the manual removal process. Furthermore, the current invention is fully adjustable and therefore adaptable to the majority of small "fleet-sided" trucks currently in service in the United States of America.

2. Summary of the Invention

According to one aspect of the invention, a fixture to be used in conjunction with a standard engine crane for the hoisting of a fleet-bed truck bed is disclosed. The basic fixture comprises a central beam, a left strut and a right strut, with the central beam attached to the midpoint of each strut forming an I-structure. Attached to each of the four ends of the struts is a strut extension arm, and there is a lift fitting attached to the entire structure.

According to another aspect of the invention, the fixture may be lowered into the truck body and then the strut extension arms may be adjusted so that all four arms engage the lip of the truck body and are captured therein, so that the engine crane may be attached to the lift fitting at a single point and the truck body lifted off the truck chassis.

According to another aspect of the invention, the strut extension arms may be secured in a fixed position after adjustment.

According to yet another aspect of the invention, the attachment of the central beam to the struts is also adjustable, and may also be fixed after adjustment.

According to still another aspect of the invention, the strut extension arm further comprise an extension main member, an extension diagonal member, and an extension load support.

According to a final aspect of the invention, the lift fitting further comprises a single bracket adjustably positioned along the central beam by a lead-screw and ball nut mechanism, so that the position of the lift fitting may be adjusted to level the load prior to lifting.

BRIEF DESCRIPTION OF THE DRAWINGS

These, and further features of the invention, may be better understood with reference to the accompanying specification and drawings depicting the preferred embodiment, in which.

DETAILED DESCRIPTION OF THE PREFERRED EMBODIMENTS

In all of the preferred embodiments a fixture is disclosed which is used in conjunction with a standard engine crane. A typical engine crane, which is not part of the invention, is shown in FIG. 1 in use with the fixture, lifting a truck body 120.

Figure 1:
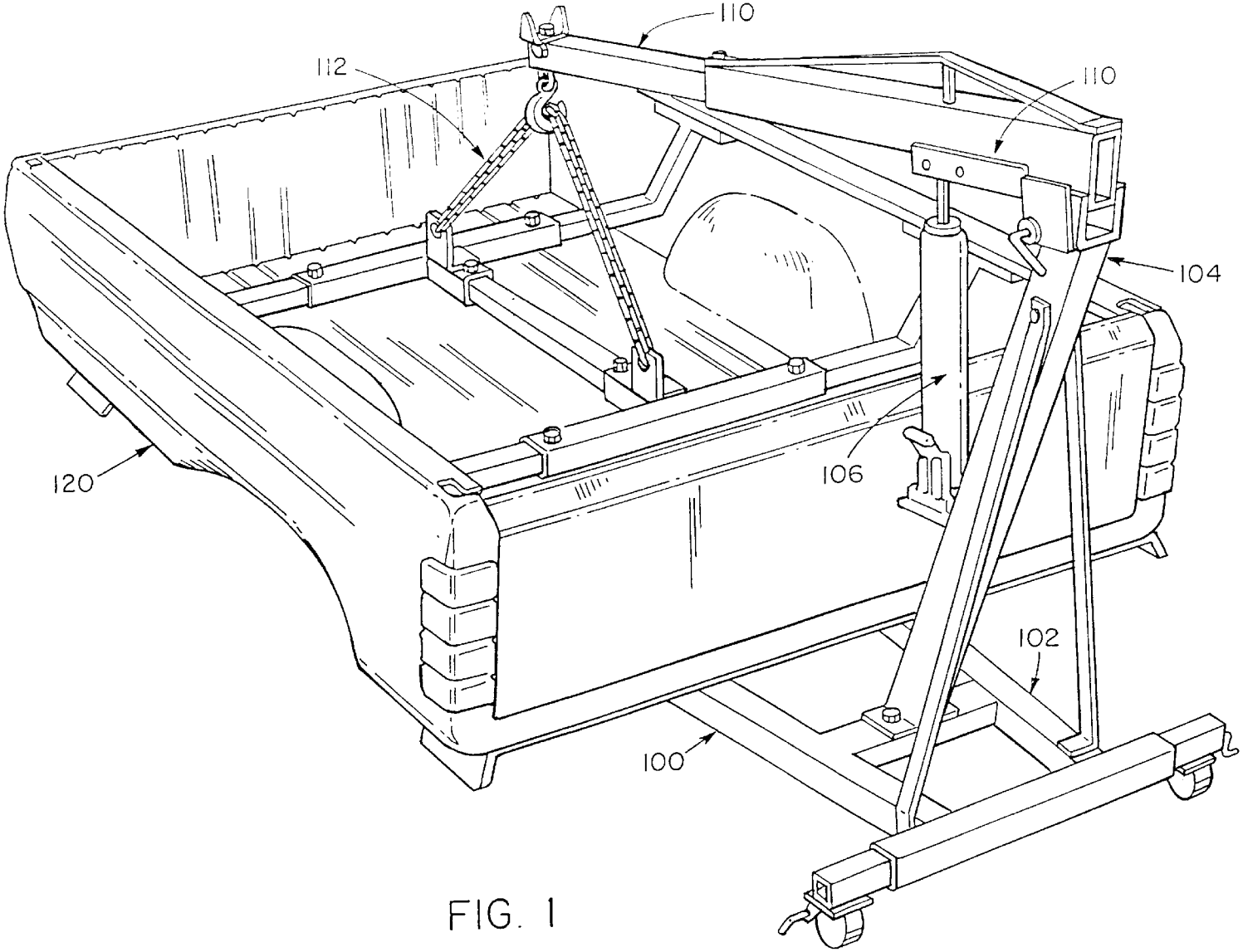
FIG. 1 depicts the fixture used in the lifting of a truck bed.

The crane of FIG. 1 has crane legs 100 and 102, a crane body 104, a hydraulic element 106, a crane arm 110, and a crane arm extension 110. A chain 112, which, like the crane, is not part of the invention, is shown.

Figure 2:
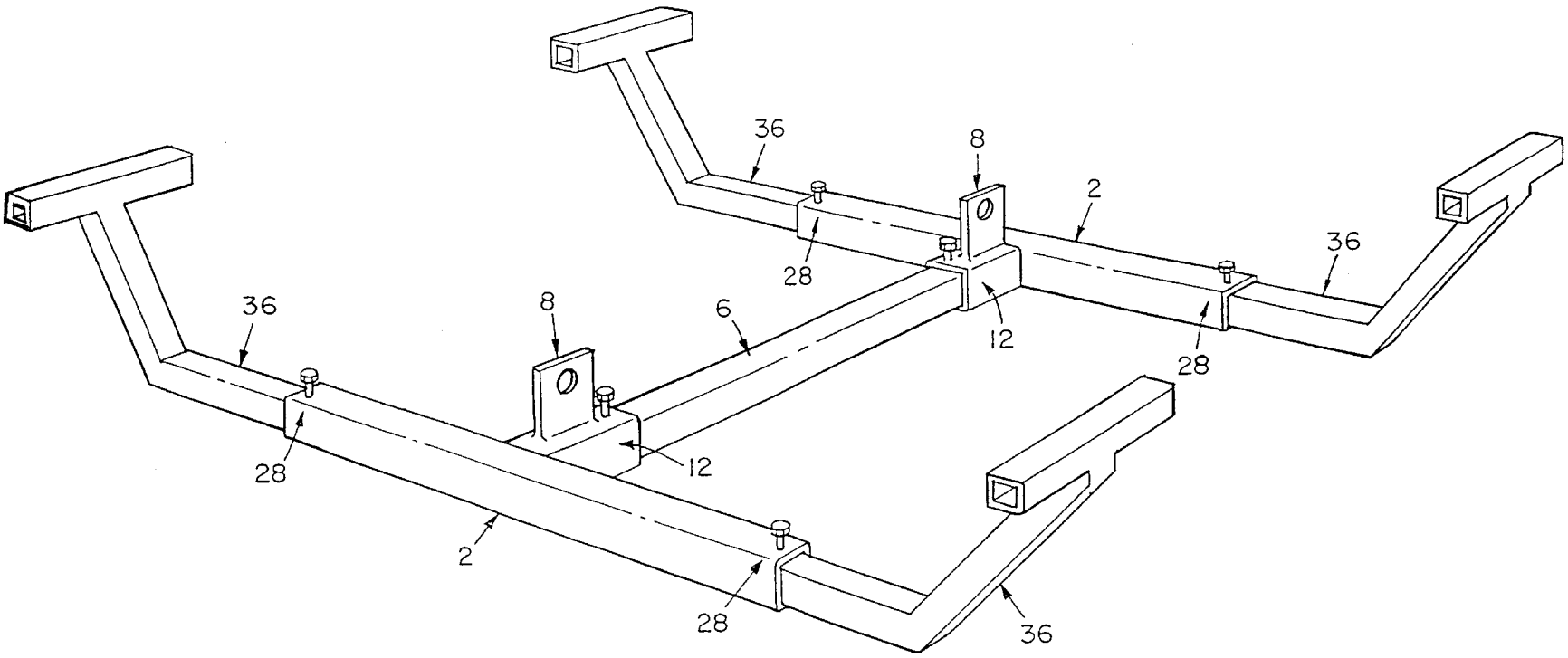
FIG. 2 depicts an isometric view of the first preferred embodiment of the fixture.

In its first preferred embodiment the fixture, which is shown in FIG. 2, comprises two identical struts 2 adjustably attached to a central beam 6, forming an I-shaped assembly as shown. The main beam members are formed from commercially-available iron square tubing stock, having a square cross section approximately 2.5 inches by 2.5 inches, and having a nominal wall thickness of 0.1875 inches.

Each strut has welded to it an identical perpendicular fitting 12 of the same material as the struts 2, and into which is inserted the central beam 6. The central beam is also of commercially available iron square tubing, but having a square cross section of approximately 2 inches by 2 inches and a nominal wall thickness of 0.125 inches.

Each fitting has an identical lift bracket 8 welded to it, each lift bracket containing a central hole through which a chain, rope, or cable may be inserted to allow attachment of the fixture to the engine crane.

Figure 3:
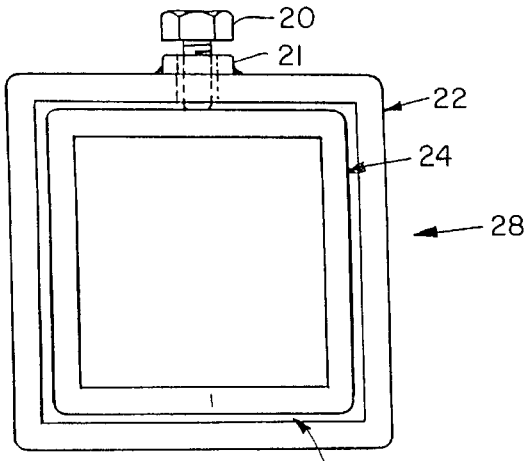
FIG. 3 depicts a cross-section view of the friction adjuster used at the strut ends and at the perpendicular fittings.

Each fitting also contains a friction adjuster 28, shown in FIG. 3, which consists of a bolt 20 extending through the body of the outer member 22, to which a mating nut 21 has been welded. As the bolt is rotated within the nut and the shank of the bolt extended forward through the body of the outer member, it makes contact with the inner member 24, pressing the inner member against the outer member at location 26. The friction thus created prevents the inner member from sliding relative to the outer member, and allows the distance between the struts to be adjusted as desired and then fixed in place.

Figure 4:
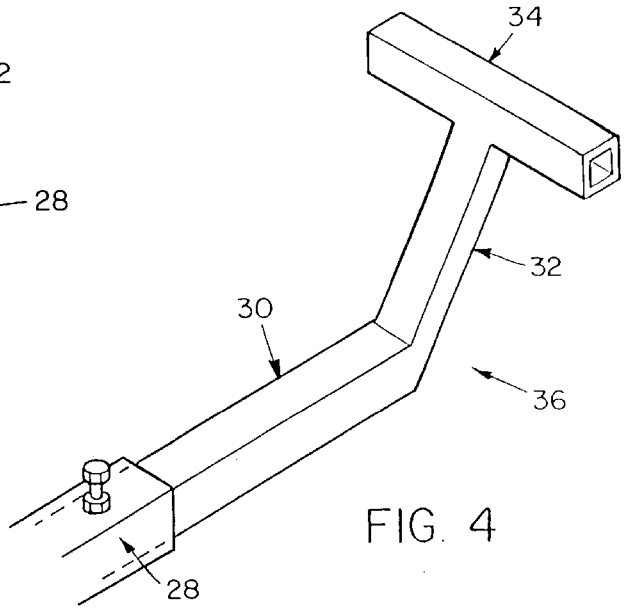
FIG. 4 depicts an isometric view of the extension arms.

At each end of each strut is attached an identical extension arm 36, comprising an extension main member 30, an extension diagonal member 32, and an extension load support 34, all of which are welded together to form a rigid structure, as shown in FIG. 4. The extension main member 30 and the extension diagonal member 32 are formed of the same material as the central beam 6, so that each of the four extension arms adjustably slide into one of the four ends of the two struts.

Each strut end is fitted with a friction adjuster located near the end of the strut, as shown in FIG. 2. By means of these friction adjusters, the fixture may be easily lowered into the truck bed and then adjusted so that the fixture fits snugly under the lip of the bed. As has been previously noted, the "fleet-bed" style truck bed has such a lip, which facilitates the use of the current invention.

Figure 5:
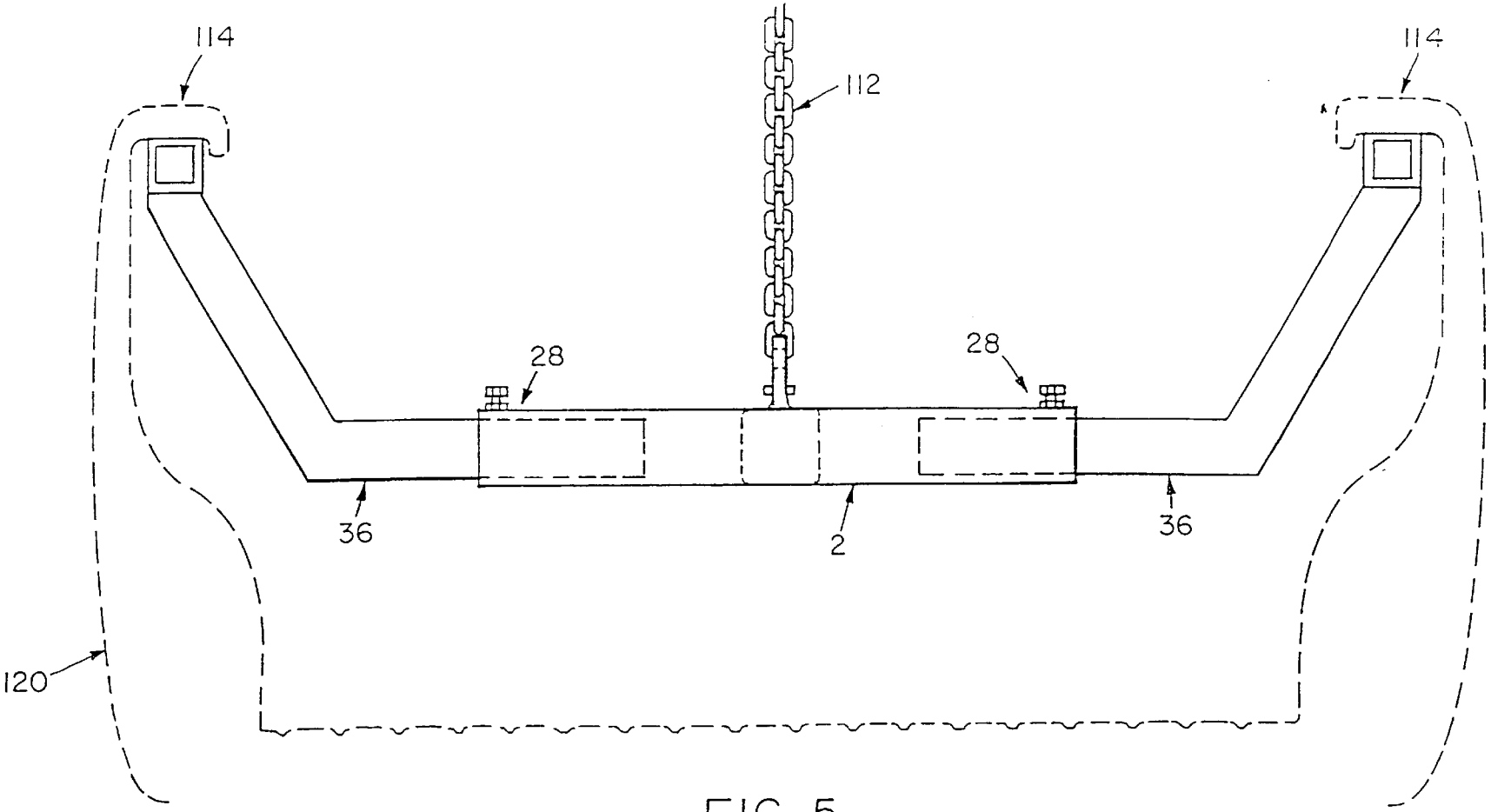
FIG. 5 depicts a cross section view of the first preferred embodiment of the fixture in place within a truck bed and ready to hoist the truck bed.

FIG. 5 shows the fixture located within the truck bed, wherein the lifting of the bed may proceed. The fixture is first attached to the crane by means of the chain 112, and then wheeled to a position over the truck bed. The fixture assembly is then lowered into the truck bed using the hydraulic mechanism provided as part of the crane. The struts are then extended as far as the truck bed will permit, and the extension arms are likewise extended as far as the truck bed will permit. The entire assembly is then raised by means of the crane's hydraulic mechanism, and final adjustments made so that the extension load supports 34 fit snugly beneath the truck lip 114. The friction adjusters are then tightened, giving the entire fixture structure mechanical stability.

Figure 7:
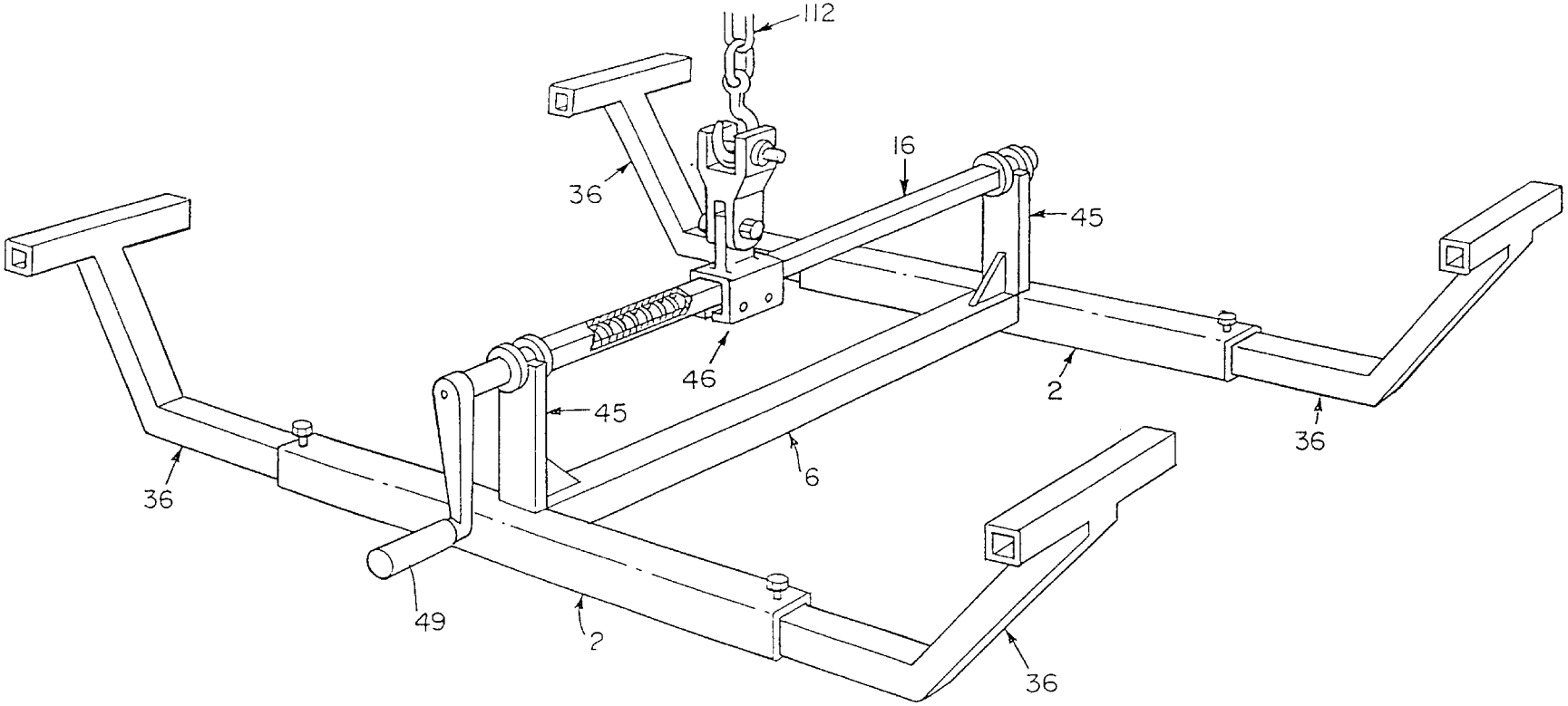
FIG. 7 depicts an isometric view of the second preferred embodiment.

In a second preferred embodiment, as shown in FIG. 7, the fixture is similar to the first preferred embodiment, except that lift brackets 8 are omitted. In their place a load leveler is provided. The load leveler provides a quick and easy means for lifting the truck bed and fixture combination at the exact center of gravity of said combination. Without use of the load leveler, it is necessary to make successive "guess and test" adjustments on the chain 112 to accomplish proper center of gravity location.

Figure 6C:
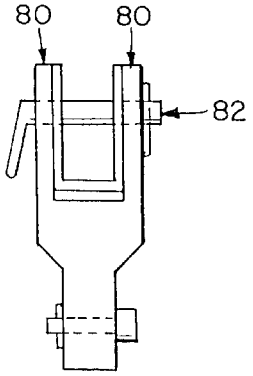
FIG. 6*c* depicts the shackle used in the load adjuster bracket.
Figure 6B:
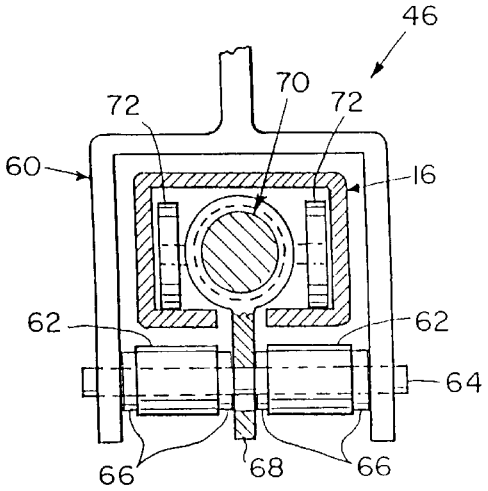
FIG. 6*b* depicts a cross-section view of the ball-nut/lead-screw mechanism.
Figure 6A:
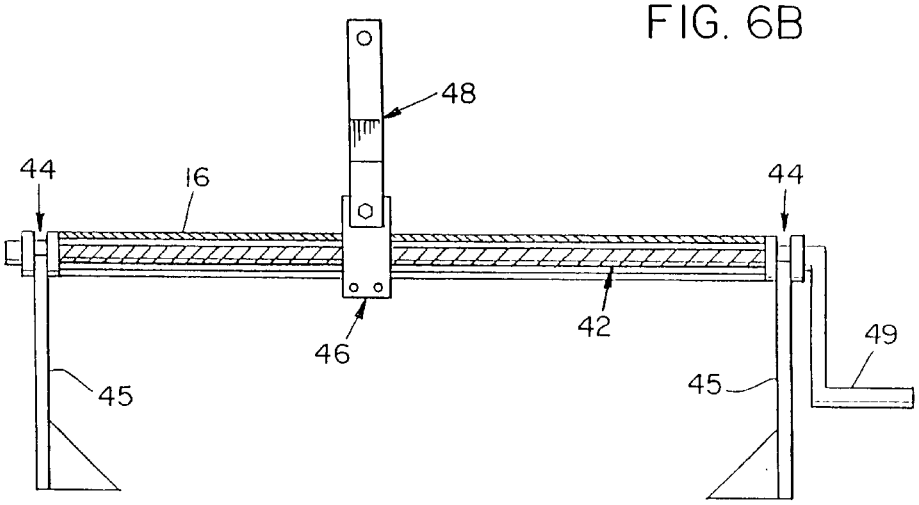
FIG. 6*a* depicts the load adjuster of the second preferred embodiment.

FIGS. 6*a* and 7 show the load leveler mechanism. The mechanism comprises a lead screw 42 which extends inside and along the length of the adjuster beam 16 which is offset above the central beam 6 by means of two identical brackets 45. The lead screw is supported by bearings 44 at either end of the adjuster beam, and contains a ball nut assembly 46 to which the load adjuster bracket 48 is rigidly attached. There is also a crank 49 which is rigidly attached to the lead screw 42, allowing adjustment of the mechanism. The adjuster beam in this embodiment has a groove cut lengthwise along the entire length of the beam, allowing access to the ball nut assembly.

FIG. 6*b* shows the detail of the ball-nut assembly. The assembly comprises a ball-nut shackle 60 which encloses the adjuster beam 16, which shackle rides on bearings 62 which rotate on axle 64 and are contained by bushings 66. The lead-screw follower 70 is located within the adjuster beam 16 and is supported by follower bearings 72. The follower has a tab 68 containing a slot through which the axle 64 passes, thus capturing the follower 70 and causing the assembly 46 to translate along the length of the adjuster beam 16 as the crank is turned.

It should be noted that the entire weight of the load is supported by the bushings 62 as they bear on the bottom of the adjuster beam 16. Thus, although the leadscrew 42 provides for translation of the ball nut assembly 46, the leadscrew does not bear any of the weight of the load.

The upper end of the load adjuster bracket forms a shackle as shown in FIG. 6*c*. The shackle contains two arms 80 and 80, which attach to the crane arm extension at a single point by means of pin 82 which extends through a hole in each of the shackle arms. The actual attachment to the crane arm extension may be made in one of several ways. In the embodiment shown in FIG. 6, a chain 112 attaches to the shackle pin 82 at one end, and to the crane arm extension at the other end. In a third embodiment the crane arm extension fits between the shackle arms 80, and a hole drilled in the crane arm extension allows the pin to make the attachment.

In operation, the second embodiment is similar to the first, except that in the second embodiment the crank may be used to adjust the point at which the load (consisting of the fixture and the truck bed) is lifted, so that this lifting point can coincide with the load's center of gravity. The lead-screw/ball-nut mechanism is designed so that this adjustment may be made while the full load is fully suspended from the engine crane, thus allowing the hoisting operation to be done rapidly and easily by a single operator.

While the invention has been described with reference to specific embodiments, it will be apparent that improvements and modifications may be made within the purview of the invention without departing from the scope of the invention defined in the appended claims.

I claim:

1. A fixture to be used in conjunction with an engine crane for the hoisting of trucks of the type which comprise a bed and a frame, the bed having an open part into which cargo can be loaded, the bed further having a lip formed about said open part, and the fixture comprising:

a central beam having a first end and a second end;

a left strut and a right strut, each strut having two ends and a midpoint, the central beam detachably attached at its first end to the midpoint of the right strut, the central beam detachably attached at its second end to the mid point of the left strut, thereby forming an I-structure;

four strut extension arms, each of which is adjustably attached to a strut end and each strut extension arm comprising:

an extension main member; and an extension diagonal member rigidly affixed to the extension main member and extending diagonally from the extension main member;

a lift fitting rigidly attached to the I-structure; and means for fixing the position of the strut extension arms on the struts, whereby the fixture may be lowered onto the bed and then the strut extension arms may be adjusted so that all four arms engage said lip and are captured therein, and so that the engine crane may be attached to the lift fitting and the bed lifted off the frame thereby.

2. The fixture of claim 1, further comprising means for fixing the detachable attachments between the central beam and the struts.

3. The fixture of claim 2, wherein each strut extension arm further comprises an extension load support rigidly affixed to the diagonal member, whereby each strut extension arm may be adjustably attached to a strut end and positioned so that the extension load support fits under the lip of the truck bed, the position of the strut extension arms on the struts are fixed by means of the means for fixing said position, and the entire fixture thus adjusted to fit snugly and securely under the lip of the truck bed so that raising the fixture will likewise raise the truck bed.

4. The fixture of claim 3, wherein the lift fitting comprises a bracket with means for attaching said bracket to the engine crane.

5. The fixture of claim 4, wherein the means for fixing the detachable attachments between the central beam and the struts and the means for fixing the position of the strut extension arms on the struts comprise friction-adjuster means.

6. The fixture of claim 5, wherein the means for attaching the brackets to the engine crane comprise chain means.

7. The fixture of claim 3, wherein the lift fitting comprises a multiplicity of brackets with means for attaching said brackets to the engine crane.

8. The fixture of claim 7, wherein the means for fixing the detachable attachments between the central beam and the struts and the means for fixing the position of the strut extension arms on the struts comprise friction-adjuster means.

9. The fixture of claim 8, wherein the means for attaching the brackets to the engine crane comprise chain means.

* * * * *